US007937025B2

(12) United States Patent
Nohsho et al.

(10) Patent No.: US 7,937,025 B2
(45) Date of Patent: May 3, 2011

(54) SCOROTRON CORONA CHARGER, PROCESS CARTRIDGE, AND IMAGE FORMING APPARATUS

(75) Inventors: Shinji Nohsho, Numazu (JP); Yoshiki Yanagawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/552,666

(22) Filed: Sep. 2, 2009

(65) Prior Publication Data

US 2010/0067953 A1 Mar. 18, 2010

(30) Foreign Application Priority Data

Sep. 12, 2008 (JP) ..... 2008-234314

(51) Int. Cl.
*G03G 15/02* (2006.01)

(52) U.S. Cl. ..... 399/171; 324/324

(58) Field of Classification Search ..... 399/170, 399/171, 311; 250/324, 325, 326
See application file for complete search history.

(56) References Cited

U.S. PATENT DOCUMENTS

| | | | | |
|---|---|---|---|---|
| 3,954,568 | A | 5/1976 | DuPree | |
| 5,147,751 | A | 9/1992 | Kojima et al. | |
| 2008/0219694 | A1 | 9/2008 | Nakamori et al. | |
| 2009/0148186 | A1 * | 6/2009 | Yasuda et al. | 399/170 |

FOREIGN PATENT DOCUMENTS

| | | |
|---|---|---|
| JP | 52-36016 | 9/1977 |
| JP | 62-89660 | 6/1987 |
| JP | 2001-109233 | 4/2001 |
| JP | 2002-169444 | 6/2002 |
| JP | 2002-268454 | 9/2002 |
| JP | 2003-43894 | 2/2003 |
| JP | 2004-29253 | 1/2004 |
| JP | 2004-325994 | 11/2004 |
| JP | 2005-227470 | 8/2005 |
| JP | 2006-251008 | 9/2006 |

* cited by examiner

*Primary Examiner* — Sophia S Chen
(74) *Attorney, Agent, or Firm* — Cooper & Dunham LLP

(57) ABSTRACT

A scorotron corona charger including a grid electrode is provided. A layer including a zeolite, a resistance controlling agent, and a binder is formed on the grid electrode. The binder resin has a solubility parameter of 10.0 $cal^{1/2}cm^{-3/2}$ or less.

3 Claims, 4 Drawing Sheets

SCOROTRON CORONA CHARGER, PROCESS CARTRIDGE, AND IMAGE FORMING APPARATUS

BACKGROUND OF THE INVENTION

1. Field of the Invention

The present invention relates to a corona charger for use in electrophotographic image forming apparatuses. More particularly, the present invention relates to a scorotron corona charger including a grid electrode. In addition, the present invention also relates to a process cartridge and an image forming apparatus including the scorotron corona charger.

2. Discussion of the Related Art

In a typical electrophotographic image forming apparatus, first, a surface of a photoreceptor is evenly charged, and the charged surface is then exposed to a light beam modulated by image information to form an electrostatic latent image thereon. A toner is supplied to the electrostatic latent image to form a toner image on the surface of the photoreceptor. The toner image is transferred onto a recording medium directly or via an intermediate transfer member, and then fixed thereon upon application of heat and pressure. Residual toner particles remaining on the surface of the photoreceptor are removed by a cleaning blade.

Corona chargers are typically used for charging photoreceptors.

Corona discharge is a continuous discharge phenomenon that occurs upon local dielectric breakdown of air in an uneven electric field. A typical-corona charger has a configuration in which a corona wire with a micro-diameter is stretched taut in a shield case made of aluminum, a part of which is eliminated. Corona ions are discharged from the part of the shield case which is eliminated. As the voltage applied to the corona wire increases, a strong electric field is locally formed at the periphery of the corona wire, causing local dielectric breakdown of air and thus continuous discharge of electricity.

The type of corona discharge largely depends on the polarity of the voltage applied to the corona wire. A positive corona discharge causes an even electric discharge on the surface of the corona wire, whereas a negative corona discharge causes a local streamer discharge. Accordingly, the positive corona discharge has an advantage over the negative corona discharge in evenness of electric discharge. In addition, the negative corona discharge produces several tens of times the amount of ozone produced by the positive corona discharge, thereby increasing environmental load.

FIG. 1A is a schematic view illustrating an embodiment of a corotron corona charger. A charging wire made of tungsten with a diameter of 50 to 100 μm is shielded with a metal case forming a gap of about 1 cm therebetween. A high voltage of 5 to 10 kV is applied to the wire, while an opening is disposed facing a charging target. Thus, positive or negative ions are moved to a surface of the charging target, resulting in charging of the charging target.

FIG. 2A is a graph showing a relation between the charging time and the surface potential of a charging target with respect to the corotron corona charger. It is apparent from FIG. 2A that the corotron corona charger continuously charges the charging target, in other words, continuously discharges electricity. Therefore, the corotron corona charger is not always suitable for charging a charging target to a predetermined potential, whereas it is suitable for constantly charging a charging target.

FIG. 1B is a schematic view illustrating an embodiment of a scorotron corona charger. The scorotron corona charger was developed for the purpose of reducing unevenness in the resultant potential of a charging target. As illustrated in FIG. 1B, the scorotron corona charger has a configuration in which a plurality of wires or a mesh is provided as a grid electrode in an opening of the metal shield case. The opening is disposed facing a charging target, and a bias voltage is applied to the grid electrode.

FIG. 2B is a graph showing a relation between the charging time and the surface potential of a charging target with respect to the scorotron corona charger. It is apparent from FIG. 2B that the surface potential of the charging target is saturated at a predetermined charging time. This is because a voltage applied to the grid electrode controls the surface potential of the charging target. The saturation value depends on the voltage applied to the grid electrode.

Although having a more complicated configuration and providing a lower charging efficiency than the corotron corona charger, the scorotron corona charger is widely used because of having an advantage in evenness of charging. The grid electrode may be hereinafter described as "charging grid" also.

It is known that both corotron and scorotron corona chargers typically produce discharge products such as $O_3$, $NO_x$, nitrate ion, and ammonium ion, because substances in the air such as oxygen atoms and nitrogen atoms are reacted upon a high-voltage discharge of from 5 to 10 kV. These discharge products may adhere to or permeate in a photoreceptor (i.e., charging target), and therefore abnormal images with white spots, black bands, blurring, etc., may be disadvantageously produced.

In attempting to solve such problems, Unexamined Japanese Patent Application Publication No. (hereinafter "JP-A") 2005-227470 discloses a corona charger, the charging grid of which is made of stainless steel and coated with a conductive coating composition including an organic binder resin and fine particles of graphite, nickel, and an aluminum compound. It is disclosed therein that such a configuration prevents corrosion of the charging grid because the conductive coating layer adsorbs discharge products. Accordingly, a charging target is prevented from being contaminated with discharge products. However, since the fine particles in the conductive coating layer adsorb discharge products, the capacity for adsorbing discharge products depends on the number of adsorbing sites in the fine particles, and there is a possibility that the adsorbing sites become buried with long-term use.

Unexamined Japanese Utility Model Application Publication No. 62-089660 discloses a corona charger in which finely partitioned communicating holes are arranged within an opening, and an ozone-adsorbing layer containing an ozone-adsorbing material is further formed on the inner surface of the communication holes. A zeolite and an activated carbon are used as the ozone-adsorbing material. It is disclosed therein that such a configuration prevents diffusion of ozone. However, it is difficult to prevent ozone from diffusing toward a charging target side, possibly contaminating a charging target with ozone.

JP-A 2003-43894 discloses an image forming apparatus including a corona charger and a means for removing (adsorbing) discharge products adhered to a charging target, and at least one of a means for preventing adhesion of discharge products to the charging target, a means for preventing lowering of the resistance of the discharge products adhered to the charging target, and a means for reducing the amount of discharge products produced at the periphery of the charging target. Accordingly, multiple members are needed, which is disadvantageous. An embodiment is also disclosed therein in which an adsorbent such as a zeolite is provided between the charging target and the corona charger. However, such an embodiment cannot reliably charge the charging target.

SUMMARY OF THE INVENTION

Accordingly, exemplary embodiments of the present invention provide a scorotron corona charger which can reduce the amount of discharge products that are produced by corona discharge, and which can reliably prevent contamination of environment and charging targets.

These and other features and advantages of the present invention, either individually or in combinations thereof, as hereinafter will become more readily apparent can be attained by exemplary embodiments described below.

One exemplary embodiment provides a scorotron corona charger including a grid electrode on which a layer including a zeolite, a resistance controlling agent, and a binder is formed. The binder resin is a hydrophobic resin having a solubility parameter of 10.0 or less, expressed as $cal^{1/2}cm^{-3/2}$.

Another exemplary embodiment provides a process cartridge detachably provided to an image forming apparatus. The process cartridge includes an electrophotographic photoreceptor and the above-described scorotron corona charger for charging the electrophotographic photoreceptor.

Yet another exemplary embodiment provides an image forming apparatus including an electrophotographic photoreceptor, the above-described scorotron corona charger for charging the electrophotographic photoreceptor, an irradiator for irradiating the charged electrophotographic photoreceptor to form an electrostatic latent image thereon, a developing device for developing the electrostatic latent image with a toner to form a toner image, a transfer device for transferring the toner image onto a recording medium, and a fixing device for fixing the toner image on the recording medium.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Exemplary embodiments of the present invention are provided in view of the following findings:

1) Zeolite is effective for removing discharge products;
2) An effective way to remove discharge products from a corona charger is to make a grid electrode retain zeolite;
3) In a case in which a grid electrode retains zeolite, the grid electrode has a predetermined resistance so as to function as charge control electrode;
4) It is effective that a grid electrode retains zeolite using a hydrophobic binder resin, in order not to inhibit an ability of zeolite to remove discharge products; and
5) A hydrophobic binder resin with predetermined hydrophobicity is prevented from getting into fine pores of zeolite, which means that zeolite can keep high ability to remove discharge products.

Figure 3:
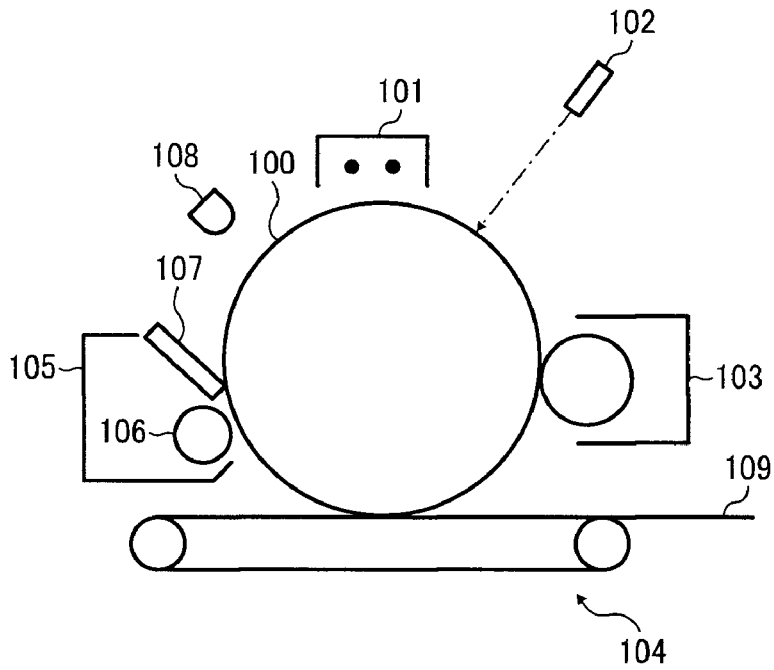
FIG. 3 is a schematic view illustrating an exemplary embodiment of an electrophotographic image forming apparatus.

FIG. 3 is a schematic view illustrating an exemplary embodiment of an electrophotographic image forming apparatus. A photoreceptor 100 is charged to a potential of ±600 to 1400 V by a charger 101. The charged photoreceptor 100 is then irradiated with a light beam emitted from a light irradiator 102 so that a latent image is formed thereon. For example, in an analog copier, an original image is irradiated with a light beam emitted from an irradiating lamp, the irradiated image is then reflected by a mirror, and the reflected mirror image is projected onto the photoreceptor. As another example, in a digital copier, an original image is read by a CCD (charge-coupled device) so as to be converted into a digital signal of an LD or LED having a wavelength of 400 to 780 nm, and the digital signal forms an image on the photoreceptor. Accordingly, the wavelength of the light beam for forming a latent image on the photoreceptor varies depending on whether the copier is analog or digital. At a time of the irradiation, charge separation occurs in a photoconductive layer of the photoreceptor, resulting in formation of a latent image.

The latent image formed on the photoreceptor 100 is then developed with a developer in a developing device 103 to form a toner image. The toner image thus formed on the photoreceptor 100 is then transferred onto a recording sheet 109 upon application of a voltage to a transfer device 104. The applied voltage is controlled so that a constant current flows in the photoreceptor 100. On the other hand, residual toner particles that remain on the photoreceptor 100 without being transferred onto the recording sheet 109 during development of the latent image into a toner image are removed by a cleaning device 105. The cleaning device 105 includes a cleaning brush 106 and a cleaning blade 107 made of an elastic rubber. Subsequently, residual latent images that remain on the photoreceptor 100 are removed by a decharging device 108 so that the photoreceptor 100 is prepared for a next image forming operation. Thus, a series of image forming processes is finished.

The above-described image forming members may be directly mounted on an image forming apparatus such as a copier, a facsimile, and a printer. Alternatively, they may be integrally supported as a process cartridge detachably mountable on an image forming apparatus.

For example, such a process cartridge may include a photoreceptor and a charger, and at least one member selected from a developing device, a transfer device, a cleaning device, and a decharging device.

(Corona Charger)

Figure 1A:
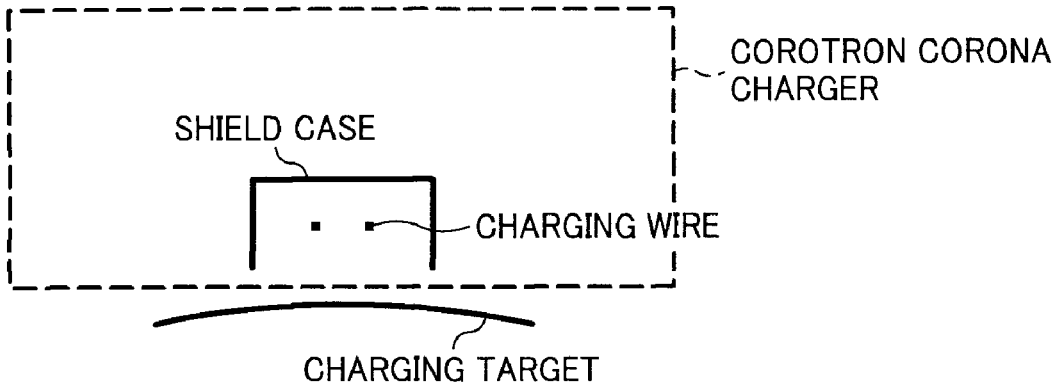
FIGS. 1A and 1B are schematic views illustrating embodiments of a corotron corona charger and a scorotron corona charger, respectively.
Figure 1B:
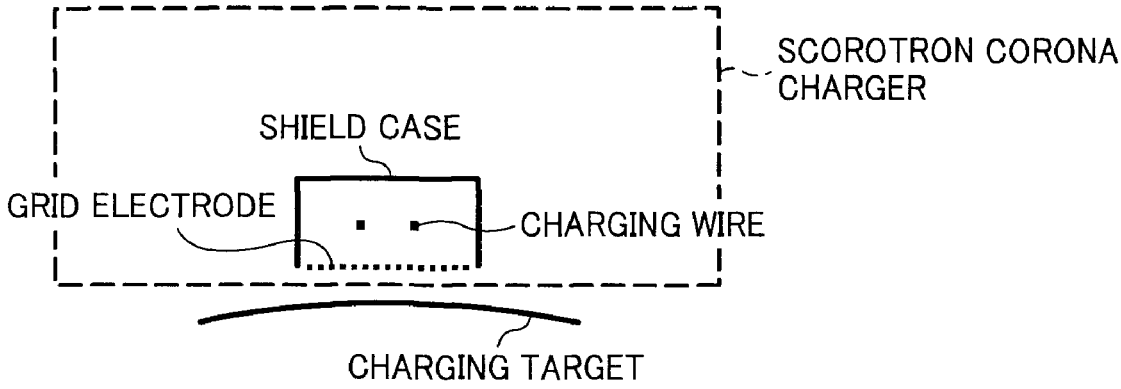
Figure 2A:
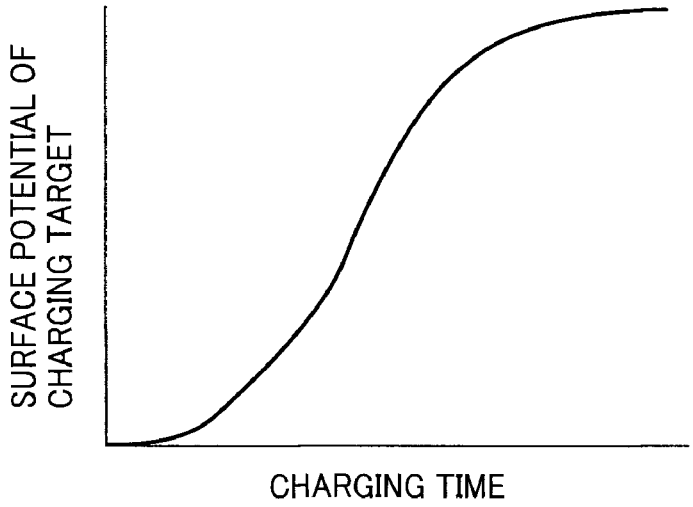
FIGS. 2A and 2B are graphs showing a relation between the charging time and the surface potential of a charging target with respect to the corotron corona charger and the scorotron corona charger illustrated in FIGS. 1A and 1B, respectively.
Figure 2B:
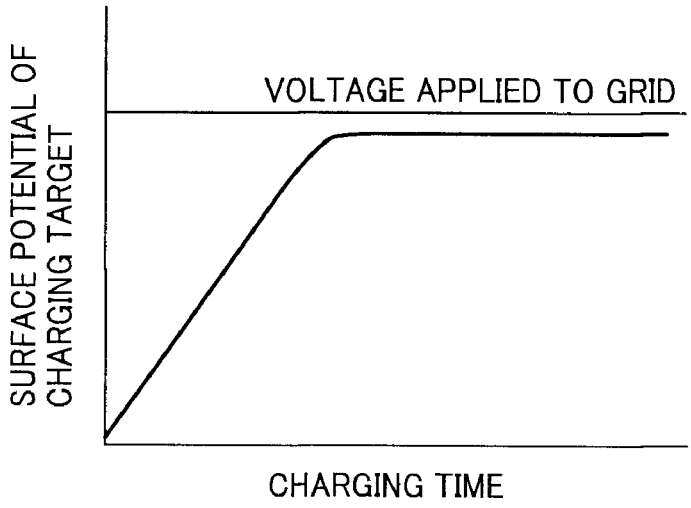
Figure 4:
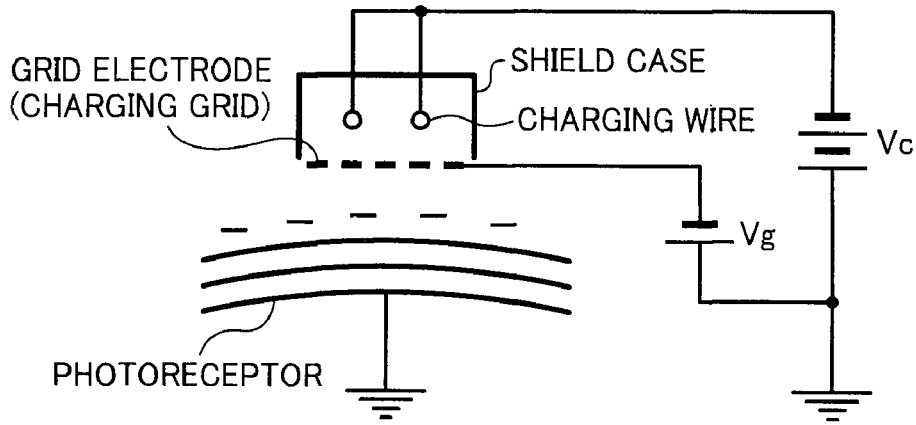
FIG. 4 is a schematic view illustrating another embodiment of a scorotron corona charger.

As described above, FIG. 1B is a schematic view illustrating an embodiment of a scorotron corona charger. The scorotron charger includes a shield case, a charging wire, and a grid electrode. FIG. 4 is a schematic view illustrating another embodiment of a scorotron corona charger. As illustrated in FIG. 4, the scorotron corona charger is provided facing a photoreceptor (i.e., charging target). A voltage Vc of from −5 to −8 kV is applied to the charging wire and a voltage Vg of from −500 to −1500 V is applied to the grid electrode, so that the photoreceptor is evenly charged to around Vg. As described above, discharge products such as $O_3$, $NO_x$, nitrate ion, and ammonium ion may be produced by high-voltage electric discharge and the discharge products may be accumulated in the charger, especially within the shield case. Therefore, an exemplary scorotron corona charger of the present invention retains zeolite for the purpose of removing discharge products.

In an exemplary scorotron corona charger, not other members but the grid electrode retains zeolite. Such a configuration effectively prevents deterioration of the photoreceptor and production of abnormal images. Since the grid electrode functions as a control electrode for evenly charging a photoreceptor, the charging wire discharges toward the grid electrode. Therefore, the grid electrode preferably has a surface resistivity of $1\times10^{10}$ Ω·cm or less. The grid electrode includes a chargeable mesh-shaped or wire-shaped metallic grid on which zeolite and a resistance controlling agent are retained. The grid electrode further includes a hydrophobic resin on the metallic grid for the purpose of decomposing harmful substances such as $NO_x$, $SO_x$, ammonia, acetaldehyde, hydrogen sulfide, and methyl mercaptan.

(Hydrophobic Resin)

Hydrophobicity and hydrophilicity of a polymer may be determined by the kinds of functional groups in the polymer, and represented by solubility parameter (hereinafter "SP value").

In the present specification, a hydrophobic resin is defined as a resin having no hydrophilic group (e.g., —OH, —$NH_2$, —$SO_3H$, and —COOH) and having a hydrophobic nonpolar group (e.g., —$CH_3$, —$CH_2CH_3$, —COOR, phenyl group).

Polyvinyl alcohols and epoxy resins, for example, are not usable for the present invention because they have a hydrophilic group. Polypropylene and polystyrenes, for example, are usable for the present invention because they have no hydrophilic group and do have a hydrophobic nonpolar group.

The solubility parameter indicates hydrophobicity. Suitable hydrophobic resins preferably have an SP value of 10.0 $cal^{1/2}cm^{-3/2}$ or less. Specific examples of such resins include, but are not limited to, PTFE (having an SP value of 6.2), butyl rubber (having an SP value of 7.3), polyethylene (having an SP value of 7.9), styrene-butadiene (having an SP value of 8.2), polystyrene (having an SP value of 9.1), chloroprene rubber (having an SP value of 9.2), polymethyl methacrylate (having an SP value of 9.2), vinyl acetate (having an SP value of 9.4), and vinyl chloride resin (having an SP value of 9.7).

When the SP value of a resin is too large, the resin may cover zeolite excessively because zeolite originally has high hydrophilicity. As a result, an ability of adsorbing polar substances such as ozone and $NO_x$ may decrease.

(Zeolite)

Zeolite is a generic name for crystalline porous aluminosilicate and is represented by the following formula (1):

$$(M^{n+})_{2/n}O.Al_2O_3.xSiO_2.yH_2O \quad (1)$$

wherein M represents a cationic ion, n represents the valence of the cationic ion M, x represents a numeral of 2 or more, and y represents a numeral of 0 or more.

In a backbone of zeolite, aluminum (+3 valences) and silicon (+4 valences) share oxygen (−2 valences) with each other. Therefore, it is electrically neutral around the silicon and negative (−1 valence) around the aluminum. The backbone requires a cationic ion to compensate the negativity. The cationic ion may be $H^+$, $Na^+$, $K^+$, or $Ca^{2+}$, for example. Different cationic ions give different properties to zeolite.

A backbone of zeolite is formed by three-dimensional combination of a structure of Si—O—Al—O—Si, thereby forming various kinds of regular backbones. The backbone that is substantially composed of silicon, aluminum, and oxygen generates even pores that may selectively incorporate water, gases, organic molecules, etc.

The kind of molecule which can be adsorbed in the pores of zeolite is determined by the size of the pores, and the size of the pores varies depending on the crystal form and the kind of cationic species of the zeolite. Therefore, the crystal form and the kind of cationic species are preferably optimized according to a target material. Zeolite generally has a crystal form of A form, X form, Y form, L form, mordenite form, ferrierite form, ZSM-5 form, or beta form, and generally includes a cationic species such as potassium, sodium, calcium, ammonium, and hydrogen. In addition, an adsorption ability and a catalytic function of zeolite also vary depending on the content ratio between aluminum and silicon included therein.

Zeolites are generally classified into natural zeolites, synthesized zeolites, and artificial zeolites. The synthesized zeolites are those commercially manufactured. The artificial zeolites are those produced from recycling materials such as coal ash.

Among various zeolites, zeolites having a crystal form of A form or X form and including a cationic ion having a high valence such as iron, aluminum, calcium, and magnesium or a monovalent cationic ion such as potassium are preferable for adsorption, ion-exchange, and decomposition of discharge products.

(Resistance Controlling Agent)

According to an exemplary embodiment of the scorotron corona charger, the grid electrode retains zeolite. Specifically, a binder resin in which zeolite is dispersed is coated on the grid electrode to form a zeolite-resin layer thereon. Although being conductive, the grid electrode may not function as a surface potential control electrode when covered with the zeolite-resin layer because electric resistance may disadvantageously become large. For the purpose of improving conductivity of the zeolite-resin layer, it is preferable that a resistance controlling agent is included in the zeolite-resin layer. Specific examples of usable resistance controlling agents include, but are not limited to, fine particles of conductive metal oxides such as indium oxide, zinc oxide, and tin oxide, and fine particles of conductive activated carbons. These materials can be used alone or in combination.

(Charging Grid)

According to an exemplary embodiment of the scorotron corona charger, a coating liquid including a zeolite, a binder resin, and a resistance controlling agent is applied to a grid electrode, followed by drying. The resultant grid electrode may be hereinafter referred to as a "charging grid". The base grid electrode may be made of stainless steel or tungsten, for example, and may have a wire-like shape or a mesh-like shape. Preferably, the base grid electrode may be an etching grid on which a net-like pattern with pitches of 0.5 to 3 mm is formed. The coating liquid is applied to the base grid electrode by spray coating, dip coating, or screen printing, optionally followed by drying by heating. Because zeolites and resistance controlling agents are generally in the form of particles, the coating liquid may be subjected to a dispersion treatment using a ball mill, a vibration mill, an ultrasonic vibrator, or a sand mill.

The weight ratio (Z/R) of the zeolite (Z) to the binder resin (R) is preferably from 1/1 to 10/1, and more preferably from 1/2 to 5/1. When the ratio of the binder resin is too large, the zeolite may be excessively covered with the binder resin and therefore adsorption ability of the zeolite may deteriorate. When the ratio of the binder resin is too small, the zeolite-resin layer may have poor strength. The amount of resistance controlling agents may be also controlled appropriately.

Preferably, the zeolite-resin layer includes a zeolite in an amount of from 30 to 50 parts, a resistance controlling agent in an amount of from 10 to 30 parts, and a binder resin in an amount of from 5 to 30 parts.

The zeolite-resin layer preferably has a thickness of from 10 to 200 μm. When the thickness is too small, abilities of adsorbing and decomposing discharge products may not last continuously. When the thickness is too large, it may be difficult to control the charged potential of a photoreceptor.

The coating liquid may be prepared by dissolving 5 to 10% by weight of a binder resin in a solvent, and further adding a zeolite and a resistance controlling agent therein while agitating the solvent. In a case in which the coating liquid is used for spray coating, the coating liquid is controlled to include solid components in an amount of 30% by weight or less.

The coating liquid may be applied to the grid electrode by spray coating, dipping, roller coating, electrophoretic coating, and the like method. From the viewpoint of even application, spray coating is preferable. Specifically, abase grid electrode is stretched taut from both ends in a direction of the long axis thereof, and then set to a cylindrical base having a diameter of 30 mm so that the long axis and the cylindrical axis are coincident. The cylindrical axis is horizontally disposed, and the cylinder is rotated at a rotation speed of 170 rpm in a circumferential direction. The coating liquid is sprayed onto the base grid electrode by horizontally scanning the spray at a scanning speed of 10 mm/sec while the base grid electrode is rotated. In order to apply the coating liquid on both sides of the base grid electrode, the base grid electrode is set to the cylindrical base forming a gap of 3 mm therebetween. The base grid electrode both sides of which are thus coated is dried in a drier for 30 minutes at 130° C. so that layers are formed and fixed on both sides of the base grid electrode. The resultant layers have a thickness of 30 μm.

(Photoreceptor)

The scorotron corona chargers of the present invention are preferably usable for charging electrophotographic photoreceptors.

Figure 5:
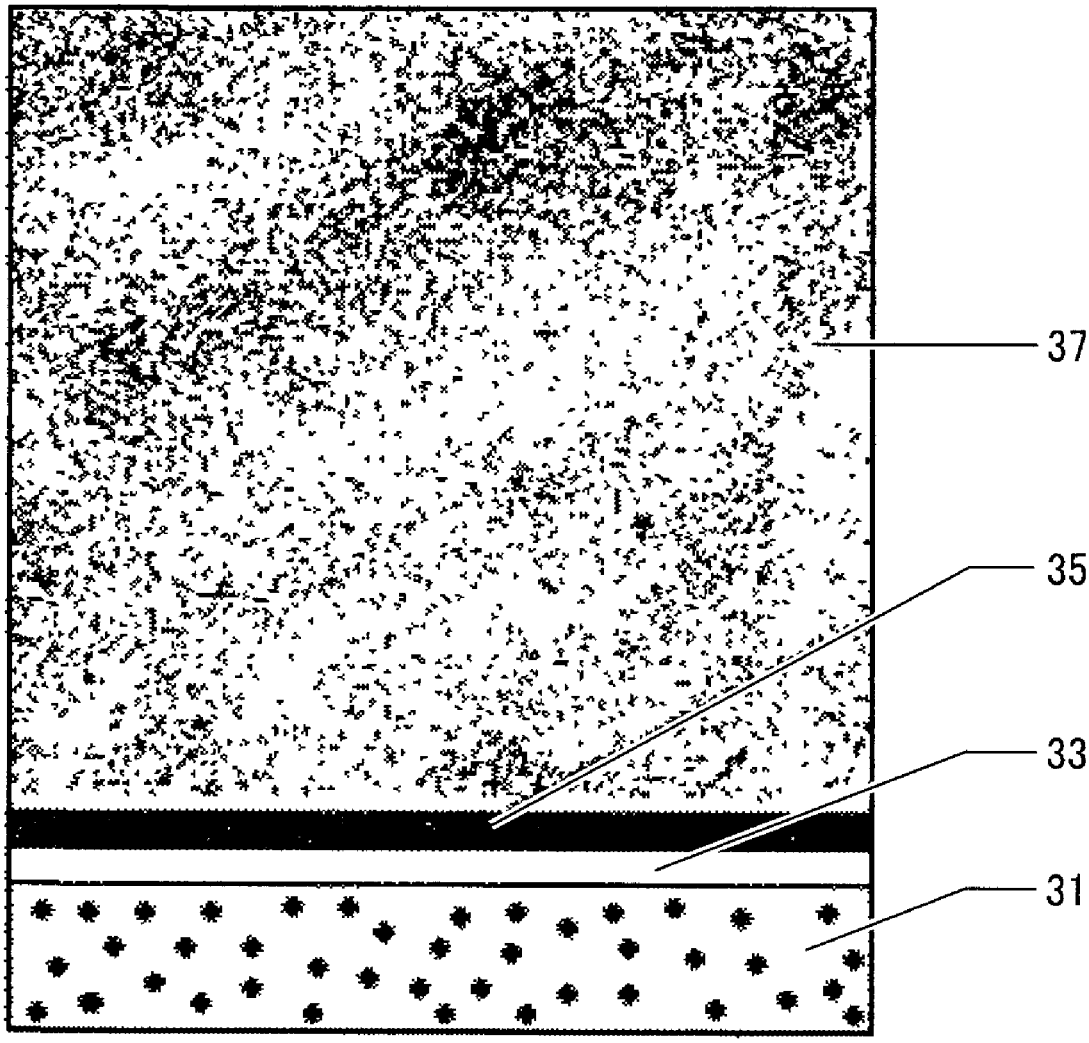
FIG. 5 is a cross-sectional schematic view illustrating an embodiment of an electrophotographic photoreceptor.

FIG. 5 is a cross-sectional schematic view illustrating an embodiment of an electrophotographic photoreceptor. The electrophotographic photoreceptor (hereinafter simply "photoreceptor") illustrated in FIG. 5 includes a conductive substrate 31, an intermediate layer 33, and a charge generation layer 35 for generating charges, and a charge transport layer 37 for transporting charges.

Suitable materials for the conductive substrate 31 include conductive materials having a volume resistivity of $10^{10}$ Ω·cm or less. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxide, indium oxide, and the like, is formed by deposition or sputtering. In addition, a metal cylinder can also be used as the conductive substrate 31, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, an endless nickel belt and an endless stainless steel belt disclosed in Examined Japanese Application Publication No. 52-36016, the disclosure thereof being incorporated herein by reference, can be also used as the conductive substrate 31.

Further, substrates, in which a conductive layer is formed on the above-described conductive substrates by applying a coating liquid including a binder resin and a conductive powder thereto, can be used as the conductive substrate 31.

Specific examples of usable conductive powders include, but are not limited to, carbon black, acetylene black, powders of metals such as aluminum, nickel, iron, nichrome, copper, zinc, and silver, and powders of metal oxides such as conductive tin oxides and ITO. Specific examples of usable binder resins include thermoplastic, thermosetting, and photocrosslinking resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. Such a conductive layer can be formed by coating a coating liquid in which a conductive powder and a binder resin are dispersed or dissolved in a proper solvent such as tetrahydrofuran, dichloromethane, methyl ethyl ketone, and toluene, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and TEFLON®, with a conductive powder, can also be used as the conductive substrate 31.

The intermediate layer 33 may be provided for the purpose of preventing injection of charge from the conductive substrate 31 and the occurrence of moiré. The intermediate layer 33 includes a binder resin as a main component and optionally includes fine particles. Specific preferred examples of suitable binder resins include, but are not limited to, thermoplastic resins such as polyvinyl alcohol, nitrocellulose, polyamide, and polyvinyl chloride, and thermosetting resins such as polyurethane and alkyd-melamine resin. Specific preferred examples of suitable fine particles include, but are not limited to, fine particles of titanium oxide, aluminum oxide, tin oxide, zinc oxide, zirconium oxide, magnesium oxide, and silica. These particles may be surface-treated. Among these materials, titanium oxide is most preferable from the viewpoint of dispersibility and electric properties. Either rutile-form or anatase-form titanium oxides can be also used.

The intermediate layer 33 can be formed by applying a coating liquid on the conductive substrate 31, followed by drying. The coating liquid is prepared by dissolving the binder resin in an organic solvent and further dispersing the fine particles therein using a ball mill or a sand mill. The intermediate layer 33 preferably has a thickness of 10 μm or less, and more preferably from 0.1 to 6 μm.

The charge generation layer 35 includes a charge generation material as a main component and optionally includes a binder resin. Usable charge generation materials include both inorganic and organic charge generation materials.

Specific examples of usable inorganic charge generation materials include, but are not limited to, crystalline selenium, amorphous selenium, selenium-tellurium compounds, selenium-tellurium-halogen compounds, selenium-arsenic compounds, and amorphous silicone. In particular, amorphous-silicone in which dangling bonds are terminated with a hydrogen or halogen atom, and that doped with a boron or phosphorous atom are preferable.

Specific examples of usable organic charge generation materials include, but are not limited to, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone and polycyclic quinone pigments, quinonimine pigments, diphenylmethane and triphenylmethane pigments, benzoquinone and naphthoquinone pigments, cyanine and azomethine pigments, indigoid pigments, and bisbenzimidazole pigments. These materials can be used alone or in combination.

Specific examples of usable binder resins for the charge generation layer 35 include, but are not limited to, polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, and polyacrylamide. These binder resins can be used alone or in combination.

Further, a charge transport polymer that has a function of transporting charge may be also usable for the charge generation layer 35. Specific examples of usable charge transport polymers include, but are not limited to, polymers such as polycarbonate, polyester, polyurethane, polyether, polysiloxane, and acrylic resins having an arylamine skeleton, a benzidine skeleton, a hydrazone skeleton, a carbazole skeleton, a stilbene skeleton, or a pyrazoline skeleton; and polymers having a polysilane skeleton.

The charge generation layer 35 may also include a low-molecular-weight charge transport material. Usable low-molecular-weight charge generation materials include both electron transport materials and hole transport materials.

Specific examples of suitable electron transport materials include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. These electron transport materials can be used alone or in combination.

Specific examples of suitable hole transport materials include, but are not limited to, electron donating materials such as oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These hole transport materials can be used alone or in combination.

The charge generation layer 35 can be formed by a typical method for forming a thin film under vacuum or a typical casting method.

Specific examples of the former method include, but are not limited to, a vacuum deposition method, a glow discharge decomposition method, an ion plating method, a sputtering method, a reactive sputtering method, and a CVD method. The above-described inorganic and organic charge generation materials are preferably used therefor.

In the latter casting method, first, the above-described inorganic or organic charge generation material, optionally together with a binder resin, are dispersed in a solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, and butyl acetate, using a ball mill, an attritor, a sand mill, or a bead mill. The resultant dispersion of the charge generation material is diluted appropriately to prepare a coating liquid. Further, a leveling agent such as a dimethyl silicone oil and a methylphenyl silicone oil may be optionally included in the coating liquid. The coating liquid is coated on a lower layer by a dip coating method, a spray coating method, a bead coating method, a ring coating method, or the like method.

The charge generation layer 35 thus prepared preferably has a thickness of from 0.01 to 5 μm, and more preferably from 0.05 to 2 μm.

The charge transport layer 37 has a function of transporting charge. The charge transport layer 37 can be formed by, for example, dissolving or dispersing a charge transport material having a function of transporting charge and a binder resin in a solvent, and the resultant solution or dispersion is applied on the charge generation layer 35, followed by drying.

Specific examples of suitable charge transport materials for the charge transport layer 37 include the above-described electron transport materials, hole transport materials, and charge transport polymers suitable for the charge generation layer 35.

Specific examples of suitable binder resins for the charge transport layer 37 include, but are not limited to, thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl chloride, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The content of the charge transport material is preferably from 20 to 300 parts by weight, and more preferably from 40 to 150 parts by weight, based on 100 parts by weight of the binder resin. The charge transport polymer can be used alone or in combination with the binder resin.

Specific examples of suitable solvents for preparing a coating liquid of the charge transport layer 37 include the above-described solvents suitable for that of the charge generation layer 35. Specifically, solvents capable of sufficiently dissolving the charge transport material and the binder resin are preferable. These solvents can be used alone or in combination. The charge transport layer 37 can be formed by the same method as the charge generation layer 35.

The charge transport layer 37 may optionally include a plasticizer and a leveling agent.

Specific examples of suitable plasticizer for the charge transport layer 37 include, but are not limited to, dibutyl phthalate and dioctyl phthalate, which are typically used as plasticizers of resins. The content of the plasticizer is preferably from 0 to 30 parts by weight based on 100 parts by weight of the binder resin.

Specific examples of suitable leveling agents for the charge transport layer 37 include, but are not limited to, silicone oils such as dimethyl silicone oil and methylphenyl silicone oil, and polymers and oligomers having a perfluoroalkyl group as a side chain. The content of the leveling agent is preferably from 0 to 1 part by weight based on 100 parts by weight of the binder resin.

The charge transport layer 37 preferably has a thickness of from 5 to 40 μm, and more preferably from 10 to 30 μm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Photoreceptor

An undercoat layer coating liquid including 6 parts of an alkyd resin (BECKOSOL 1307-60-EL from DIC Corporation), 4 parts of a melamine resin (SUPER BECKAMINE G-821-60 from DIC Corporation), 40 parts of a titanium oxide, and 50 parts of methyl ethyl ketone, a charge generation layer coating liquid including 6 parts of Y-form titanyl phthalocyanine, 70 parts of a 15% xylene-butanol solution of a silicone resin (KR5240 from Shin-Etsu Chemical Co., Ltd.), and 200 parts of 2-butanone, and a charge transport layer coating liquid including 25 parts of a charge transport material having the following formula (A), 30 parts of a bisphenol-Z type polycarbonate (IUPILON Z300 from Mitsubishi Gas Chemical Company, Inc.), and 200 parts of tetrahydrofuran, were sequentially applied to an aluminum cylinder having a diameter of 100 mm and dried, in this order. Thus, a photoreceptor (1) including, in order from an innermost side thereof, an undercoat layer having a thickness of 3.5 μm, a charge generation layer having a thickness of 0.2 μm, and a charge transport layer having a thickness of 32 μm was prepared.

(A)

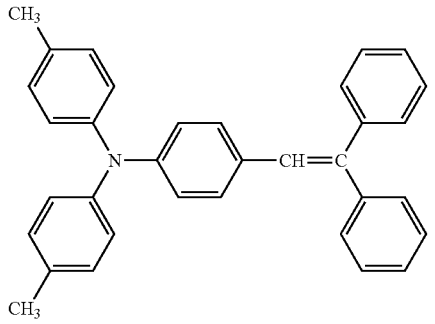

Example 1

First, 5 parts of a zeolite (an A-form zeolite A-3 from Tosoh Corporation), 3 parts of a resistance controlling agent (an activated carbon RP-20 from Kuraray Chemical Co., Ltd.), and 2 parts of a binder resin (a polystyrene having an SP value of 7.9) were dissolved or dispersed in butyl acetate. The resultant mixture includes 30% by weight of solid components.

The mixture was subjected to a dispersion treatment using a ball mill for 48 hours. Thus, a coating liquid was prepared.

The coating liquid was applied to a stainless steel etching grid by spray coating so that the resultant layer has a thickness of 50 μm. The grid was mounted on a corona charger. Thus, a scorotron corona charger (1) having a coating layer including the zeolite, resistance controlling agent, and binder resin was prepared.

Example 2

The procedure for preparation of the scorotron corona charger (1) in Example 1 is repeated except for replacing the polystyrene having an SP value of 7.9 with a polymethyl methacrylate having an SP value of 9.2. Thus, a scorotron corona charger (2) is prepared.

Example 3

The procedure for preparation of the scorotron corona charger (1) in Example 1 is repeated except for replacing the polystyrene having an SP value of 7.9 with a vinyl chloride resin having an SP value of 9.7, and replacing the butyl acetate with methyl ethyl ketone. Thus, a scorotron corona charger (3) is prepared.

Comparative Example 1

The procedure for preparation of the scorotron corona charger (1) in Example 1 is repeated except for replacing the polystyrene having an SP value of 7.9 with a nitrocellulose having an SP value of 10.6, and replacing the butyl acetate with dioxane. Thus, a scorotron corona charger (4) is prepared.

Comparative Example 2

The procedure for preparation of the scorotron corona charger (1) in Example 1 was repeated except for replacing the polystyrene having an SP value of 7.9 with a 6-nylon having an SP value of 13.6, and replacing the butyl acetate with methanol. Thus, a scorotron corona charger (5) was prepared.

Evaluations

1) Evaluation of Controllability of Charging

Each of the scorotron corona chargers prepared above is mounted on an image forming apparatus IMAGIO NEO 1050PRO (from Ricoh Co., Ltd.) which includes a process cartridge at 10° C. and 15% RH. A voltage is applied to the charging grid so that a constant current flows in the charging wire and corona discharge occurs. The surface potential of the photoreceptor (i.e., a charging target) is measured when a voltage of −900 V is applied to the charging grid. In an initial stage and after 200-hour electric discharge, a halftone image is produced and visually observed whether raindrop-like marks are present or not. Evaluation results are graded as follows.

A: No raindrop-like mark is observed.

B: Raindrop-like marks are slightly observed, but allowable.

C: Raindrop-like marks are observed.

2) Evaluation of Removability of Discharge Products

Each of the scorotron corona chargers prepared above is mounted on an image forming apparatus IMAGIO NEO 1050PRO (from Ricoh Co., Ltd.) which includes a process cartridge at 10° C. and 15% RH. The image forming apparatus is brought into operation for 3 hours, and then powered down and left at rest for 15 hours. The image forming apparatus is powered up again, and a halftone image and a text image are produced and visually observed whether the image density is even or not and whether image blurring occurs or not at an area corresponding to a portion of the photoreceptor which is disposed immediately below the corona charger, in an initial stage, after 200-hour electric discharge, and after 500-hour electric discharge. Evaluation results are graded as follows.

A: The image density is even (or image blurring does not occur) at an area corresponding to a portion of the photoreceptor which is disposed immediately below the corona charger.

B: The image density is slightly uneven (or image blurring slightly occurs) at an area corresponding to a portion of the photoreceptor which is disposed immediately below the corona charger, but allowable.

C: The image density is significantly uneven (or image blurring significantly occurs) at an area corresponding to a portion of the photoreceptor which is disposed immediately below the corona charger. Unallowable.

3) Measurement of the Amount of $NO_x$ Produced by Corona Discharge

Each of the scorotron corona chargers prepared above is mounted on an image forming apparatus IMAGIO NEO 1050PRO (from Ricoh Co., Ltd.) which includes a process cartridge at 10° C. and 15% RH. A hole with a diameter of 6 mm is made on an aluminum cylinder which has the same size as the photoreceptor on the center in a longitudinal direction thereof, and a tube is attached to the hole. The aluminum cylinder is disposed in the image forming apparatus so that the hole is provided immediately below the corona charger. The image forming apparatus is brought into operation for 3 hours, and then powered down and left at rest for 15 hours. The amount of $NO_x$ produced during the 15-hour rest is measured by a $NO_x$ density measuring instrument (MODEL 42C from Thermo Electron Co., Ltd.) that is connected to the tube.

The evaluation results are shown in Tables 1 and 2.

TABLE 1

| | Controllability of Charging | | |
|---|---|---|---|
| | | Raindrop-like Marks | |
| | Surface Potential of Photoreceptor (−V) | Initial Stage | After 200-hour Discharge |
| Example 1 | −810 | A | A |
| Example 2 | −800 | A | A |
| Example 3 | −810 | A | A |
| Comparative Example 1 | −800 | A | B |
| Comparative Example 2 | −800 | A | A |

TABLE 2

| | Removability of Discharge Products | | | | |
|---|---|---|---|---|---|
| | Amount of $NO_x$ Produced | Image Evenness Immediately Below Corona Charger | | | Image Blurring |
| | by Corona Discharge (μl) | Initial Stage | After 200-hour Discharge | After 500-hour Discharge | (After 200-hour Discharge) |
| Example 1 | 0.03 | A | A | A | A |
| Example 2 | 0.01 | A | A | B | A |
| Example 3 | 0.11 | A | A | B | A |

TABLE 2-continued

| | Removability of Discharge Products | | | | |
|---|---|---|---|---|---|
| | Amount of $NO_x$ Produced | Image Evenness Immediately Below Corona Charger | | | Image Blurring |
| | by Corona Discharge (μl) | Initial Stage | After 200-hour Discharge | After 500-hour Discharge | (After 200-hour Discharge) |
| Comparative Example 1 | 0.89 | A | B | C | C |
| Comparative Example 2 | 0.95 | B | C | C | C |

It is apparent from Table 2 that when the charging grid includes zeolite, the amount of $NO_x$ that is produced by corona discharge is reduced, and therefore the occurrence of image blurring is prevented. In Comparative Examples, image evenness seems to start deteriorating after 200-hour discharge. The reason may be considered that the zeolite is prevented from adsorbing or decomposing discharge products because the binder resin disadvantageously gets into the pores of the zeolite. By comparison, in Examples, there is no problem in image quality even after 500-hour discharge because hydrophobic resins having an SP value of 10 or less are used.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-234314, filed on Sep. 12, 2008, the entire contents of which are herein incorporated by reference.

What is claimed is:

1. A scorotron corona charger, comprising:

a grid electrode on which a layer comprising a zeolite, a resistance controlling agent, and a binder resin is formed, wherein the binder resin has a solubility parameter of 10.0 $cal^{1/2}cm^{-3/2}$ or less.

2. A process cartridge detachably provided to an image forming apparatus, comprising:

an electrophotographic photoreceptor; and the scorotron corona charger according to claim 1 for charging the electrophotographic photoreceptor.

3. An image forming apparatus, comprising:

an electrophotographic photoreceptor;

the scorotron corona charger according to claim 1 for charging the electrophotographic photoreceptor;

an irradiator for irradiating the charged electrophotographic photoreceptor to form an electrostatic latent image thereon;

a developing device for developing the electrostatic latent image with a toner to form a toner image;

a transfer device for transferring the toner image onto a recording medium; and a fixing device for fixing the toner image on the recording medium.

* * * * *